US010810864B1

(12) United States Patent
Reufer et al.

(10) Patent No.: US 10,810,864 B1
(45) Date of Patent: Oct. 20, 2020

(54) MANUAL CALL POINT WITH AN E-PAPER DISPLAY

(71) Applicant: Honeywell International Inc., Morris Plains, NJ (US)

(72) Inventors: Stefan Reufer, Reken (DE); Bernd Luebben, Neuss (DE); Bernd Stoye, Leipzig (DE)

(73) Assignee: Honeywell International Inc., Charlotte, NC (US)

( * ) Notice: Subject to any disclaimer, the term of this patent is extended or adjusted under 35 U.S.C. 154(b) by 0 days.

(21) Appl. No.: 16/590,008

(22) Filed: Oct. 1, 2019

(51) Int. Cl.

| | |
|---|---|
| ***G08B 5/36*** | (2006.01) |
| ***G08B 27/00*** | (2006.01) |
| ***G08B 25/12*** | (2006.01) |
| ***G08B 25/10*** | (2006.01) |
| *G08B 17/02* | (2006.01) |
| *G08B 25/14* | (2006.01) |
| *G08B 25/00* | (2006.01) |

(52) U.S. Cl.
CPC ..... *G08B 27/005* (2013.01); *G08B 5/36* (2013.01); *G08B 25/10* (2013.01); *G08B 25/12* (2013.01); *G08B 17/02* (2013.01); *G08B 25/008* (2013.01); *G08B 25/14* (2013.01)

(58) Field of Classification Search
CPC ..... G08B 17/02; G08B 25/008; G08B 25/12; G08B 25/14; G08B 5/36
See application file for complete search history.

(56) References Cited

U.S. PATENT DOCUMENTS

2008/0262883 A1* 10/2008 Weiss ..... G06Q 30/018 705/7.42
2010/0218962 A1* 9/2010 Robb ..... G08B 25/14 169/46
2016/0335237 A1 11/2016 Alley et al.
2018/0315297 A1* 11/2018 Pavlacka ..... H05K 5/0008

FOREIGN PATENT DOCUMENTS

| | | | |
|---|---|---|---|
| DE | 19835318 | A1 | 8/1999 |
| EP | 2091032 | A2 | 8/2009 |
| GB | 2426366 | A | 11/2006 |

OTHER PUBLICATIONS

"EP210S Surface Mounting Remote Status Unit, C-TEC", https://www.c-tec.com/status-units/ep210s-remote-status-unit-surface.html, accessed May 18, 2018, 3 pages.
"Electronic Paper", https://en.wikipedia.org/wiki/Electronic_paper, accessed May 21, 2018, 12 pages.

* cited by examiner

*Primary Examiner* — Benyam Haile
(74) *Attorney, Agent, or Firm* — Brooks, Cameron & Huebsch, PLLC

(57) ABSTRACT

A manual call point with an e-paper display is described herein. One device includes an e-paper display configured to display an image that represents a status of the manual call point, a memory, and a processor configured to execute executable instructions stored in the memory to determine a change in the status of the manual call point, and change the image displayed by the e-paper display in response to the determination that there is a change in the status of the manual call point.

20 Claims, 4 Drawing Sheets

MANUAL CALL POINT WITH AN E-PAPER DISPLAY

TECHNICAL FIELD

The present disclosure relates generally to a manual call point with an e-paper display.

BACKGROUND

Large facilities (e.g., buildings), such as commercial facilities, office buildings, hospitals, and the like, may have fire alarm systems that can be used during an emergency situation (e.g., a fire). Fire alarm systems may include manual call points to initiate an alarm manually (e.g., operating a push button) once verification of the emergency situation exists.

Currently, there is no manual call point that provides feedback on the current status of the manual call point. For example, work on a fire alarm system may result in manual call points within the fire alarm system to be temporarily deactivated. Thus, technicians are forced to manually label each deactivated manual call point. This can involve travel to each individual site, cost for accommodations, time to manually label each manual call point, and other business costs.

DETAILED DESCRIPTION

Figure 1:
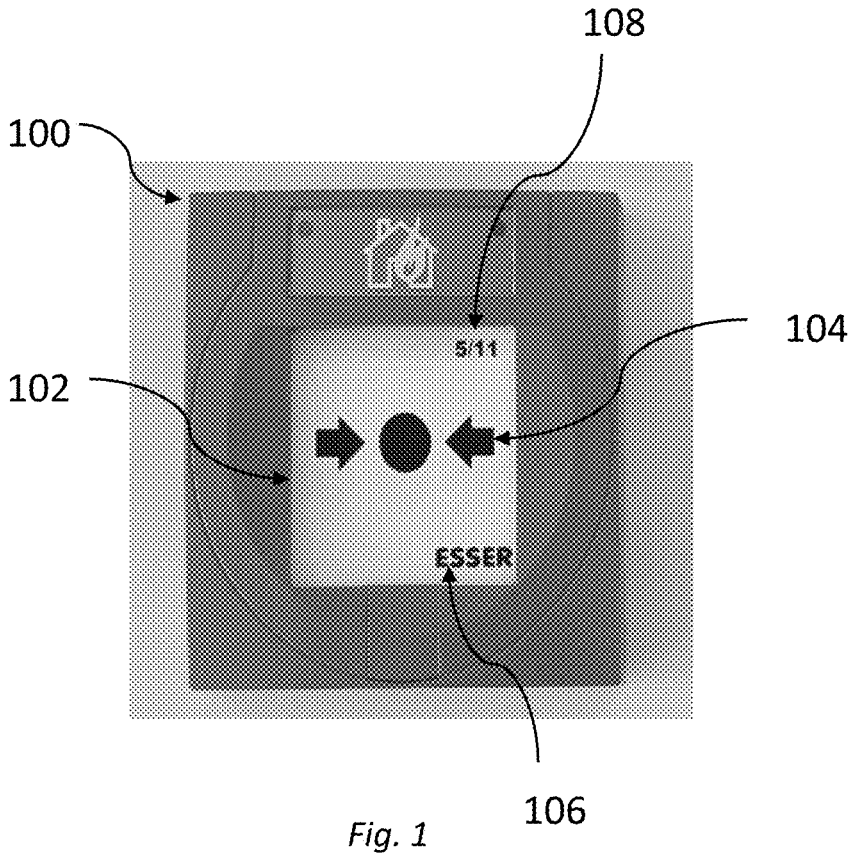
FIG. 1 illustrates an example of a manual call point in accordance with an embodiment of the present disclosure.

A manual call point with an e-paper display is described herein. For example, an embodiment includes a manual call point including an e-paper display configured to display an image that represents a status of the manual call point, a memory, and a processor configured to execute executable instructions stored in the memory to determine a change in the status of the manual call point, and change the image displayed by the e-paper display in response to the determination that there is a change in the status of the manual call point.

In contrast to previous fire alarm systems in which a manual call point is installed in a facility and it is necessary to physically label each individual manual call point, fire alarm systems in accordance with the present disclosure allow for the manual call point to determine that there is a change in the status of the manual call point and change the display of the manual call point to inform users of the current status. Accordingly, fire alarm systems in accordance with the present disclosure may self-diagnose and change the display of a manual call point in an instance when the manual call point has been deactivated.

As such, fire alarm systems in accordance with the present disclosure can be safer than previous fire alarm system that can involve temporary switch-off of the manual call points without a notification. Further, fire alarm systems in accordance with the present disclosure can make it possible to display the current status of the manual call point in an instance where the manual call point is not receiving power.

In the following detailed description, reference is made to the accompanying drawings that form a part hereof. The drawings show by way of illustration how one or more embodiments of the disclosure may be practiced.

These embodiments are described in sufficient detail to enable those of ordinary skill in the art to practice one or more embodiments of this disclosure. It is to be understood that other embodiments may be utilized and that mechanical, electrical, and/or process changes may be made without departing from the scope of the present disclosure.

As will be appreciated, elements shown in the various embodiments herein can be added, exchanged, combined, and/or eliminated so as to provide a number of additional embodiments of the present disclosure. The proportion and the relative scale of the elements provided in the figures are intended to illustrate the embodiments of the present disclosure and should not be taken in a limiting sense.

The figures herein follow a numbering convention in which the first digit or digits correspond to the drawing figure number and the remaining digits identify an element or component in the drawing. Similar elements or components between different figures may be identified by the use of similar digits.

As used herein, "a", "an", or "a number of" something can refer to one or more such things, while "a plurality of" something can refer to more than one such things. For example, "a number of components" can refer to one or more components, while "a plurality of components" can refer to more than one component.

FIG. 1 illustrates an example of a manual call point 100 in accordance with an embodiment of the present disclosure. The manual call 100 point can be utilized within a fire alarm system. The fire alarm system can be a fire alarm system of a facility (e.g., building), such as, for instance, a large facility having a large number of floors, such as a commercial facility, office building, hospital, and the like. However, embodiments of the present disclosure are not limited to a particular type of facility.

Figure 2:
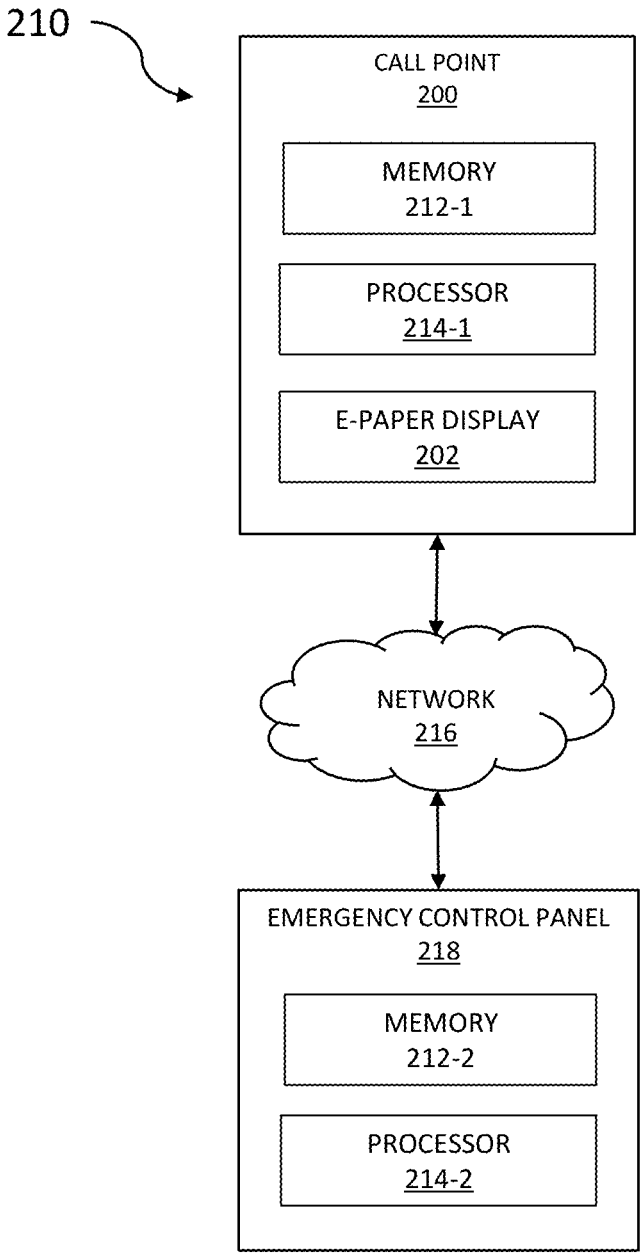
FIG. 2 illustrates an example of a system for displaying a status on a manual call point in accordance with an embodiment of the present disclosure.

Manual call point 100 can include a memory and a processor, as will be further described herein (e.g., in connection with FIG. 2).

The fire alarm system can be used during an emergency situation (e.g., a fire) to alert occupants of the emergency situation within the facility. For example, the fire alarm system may include a number of components, such as manual call points, alarms, and detectors, located throughout the facility (e.g., on different floors of the facility) that can be used to perform fire alarm operations, such as detecting, alerting, etc.

Manual call points, such as manual call point 100 shown in FIG. 1, can be installed within the facility as part of the fire alarm system. The manual call points can be connected on a loop to a fire control panel (e.g., an emergency control panel). In response to detecting an emergency situation (e.g., a fire), an occupant of the building can activate the manual call point, which notifies the fire control panel that there is an emergency situation in the facility. Additionally, manual call points can display an image that indicates to the occupants of the building the operational status of the manual call point and/or the fire alarm system.

As shown in FIG. 1, the manual call point 100 can include an electronic paper (e-paper) display 102 for displaying a status on the manual call point. E-paper displays can mimic the appearance of ordinary ink on paper. For instance, unlike conventional backlit flat panel displays that emit light, e-paper displays can reflect light like paper.

The e-paper display 102 can be configured to display an image 104 that represents a status of the manual call point 100. There can be a number of images that correspond to a number of statuses. For example, possible images can include a first image, as shown in FIG. 1, indicating that the manual call point is operating normally (e.g., functioning), a second image indicating that the manual call point has been deactivated (e.g., non-functional), and a third image indicating that maintenance is being performed on the manual call point. However, embodiments of the present disclosure are not limited to a particular image or status. In one example, each image which can be displayed on the e-paper display 102 can be stored within a memory of the manual call point, as will be further described herein (e.g., in connection with FIG. 2). Examples of such images will be further described herein (e.g., in connection with FIGS. 4A-4C).

Additionally, the manual call point can display an image that represents the status of the fire alarm system. The manual call point can be coupled to a number of devices that also correspond to the fire alarm system, such as fire detectors and an emergency control panel. In such an example, the manual call point can receive a notification from the emergency control panel that there is a fault in the fire alarm system. For example, the emergency control panel can detect or receive a notification of a change in the operational status of one of the devices of the fire alarm system, such as, for instance, a notification that the device has been deactivated. In such an example, the emergency control panel can notify the manual call point that a device that corresponds to the manual call point has been deactivated. In response to receiving the notification from the emergency control panel, the manual call point can change the display of the manual call point to an image that notifies a user that there is a fault in the fire control system (e.g., a device associated with the fire control system has been deactivated). The manual call point can also change the display of the manual call point in response to detection, by the manual call point, of a loss of communication between the manual call point and the emergency control panel.

Additionally, the e-paper display 102 can display an image 108 that represents information indicating a zone (e.g., zone 5/11 in the example in FIG. 1) the manual call point corresponds to. For example, the manual call point can correspond to a particular zone of the facility. In such an example, the facility can be separated in to multiple zones. For example, the facility may comprise a first zone that includes the first floor of the facility and a second zone that includes the second floor of the facility. Each zone may include a number of components (e.g., devices) that correspond to the fire alarm system. In such an example, each zone may include a manual call point that is configured to display the status of the manual call point and/or the status of the fire alarm system of the particular zone the manual call point corresponds to (e.g., the overall status of all of the components located within the particular zone where the manual call point is located).

While not illustrated in FIG. 1, the e-paper display 102 can also display an image that represents a call point number corresponding to the manual call point 100. The call point number can be a number assigned to the manual call point 100, allowing for easier identification of the manual call point 100. For example, the call point number can be a series of numbers and/or letters that corresponds to the manual call point 100, such as 08415-CPD-232.

Further, the e-paper display 102 can be configured to display an image 106 that represents a logo. A logo can be a symbol or other design used by an organization to identify its products. For example, the e-paper display 102 can include a logo that represents the fire alarm system company, such as ESSER in the example shown in FIG. 1.

The e-paper display 102 can be configured to display images 104, 106, and 108 in response to power not being supplied to the e-paper display 102 (e.g., in the absence of power). For instance, the e-paper display 102 can allow for the manual call point 100 to operate at low power. The power source may be an internal battery or an external power source (e.g., an AC/DC External Plug). While not illustrated in FIG. 1, the manual call point may also include dynamic (e.g., light emitting diodes that may be bi-color LED indicators in one example) along with user input switches (e.g., buttons).

The manual call point 100 can determine that there has been a change in the status of the manual call point 100. In such an example, the manual call point 100 may self-diagnose a fault of the manual call point 100. For example, the manual call point 100 can determine that the manual call point 100 has been deactivated (e.g., non-functioning).

In response to determining that the status of the manual call point 100 has changed, the manual call point 100 can change the image 104 displayed by e-paper display 102 that represents the status of the manual call point 100. In one example, the e-paper display 102 can automatically change from a first image indicating that the manual call point is functioning 100 to a second image indicating that the manual call point 100 is non-functioning. In another example, the e-paper display 102 can automatically change from a first image indicating that the manual call point 100 is non-functioning to a second image indicating that maintenance is being performed on the manual call point 100. This can allow for occupants and/or technicians to be accurately informed of the current status of the manual call point 100.

Additionally, the manual call point 100 can notify an emergency control panel that there is a change in the status of the manual call point 100 in response to determining there has been a status change. In response to the emergency control panel receiving the notification from the manual call point 100, the necessary maintenance can be performed on the manual call point 100. In such an example, the manual call point 100 can detect that maintenance is being performed and the e-paper display 102 can display an image 104 indicating that maintenance is being performed, and thus, the manual call point 100 is non-functional.

The manual call point 100 can also receive input from an occupant that an emergency situation has occurred. For example, in response to detecting an emergency situation, such as a fire, an occupant can apply pressure to the manual call point (e.g., presses a button included on the manual call point). Upon receiving such input from the user, the manual call point 100 can notify (e.g., send a message) the emergency control panel of the emergency situation. Additionally, the manual call point 100 can initiate an alarm in response to a verification (e.g., by an emergency control panel) of an emergency situation.

The manual call point 100 can secure, monitor, and/or control the components of the fire alarm system via a wired or wireless network. The network can be a network relationship through which manual call point 100 can communicate with the components of the fire alarm system, via a network (as described in relation to FIG. 2).

FIG. 2 illustrates an example of a system 210 for displaying a status on a manual call point 200 in accordance with an embodiment of the present disclosure. The manual call point 200 can be, for example, manual call point 100 previously described in connection with FIG. 1. The system 210 can also include an emergency control panel 218 capable of transmitting a notification between the manual call point 200 and the emergency control panel 218 indicating that there is a change in the status of the manual call point 200. System 210 can be, for example, a fire alarm system, as previously described herein.

As shown in FIG. 2, manual call point 200 can include a processor 214-1 and a memory 212-1 and emergency control panel 218 can include a processor 214-2 and a memory 212-2. Memory 212-1 and memory 212-2 can be any type of storage medium that can be accessed by processor 214-1 and processor 214-2, respectively, to perform various examples of the present disclosure. For example, memory 212-1 and memory 212-2 can be a non-transitory computer readable medium having computer readable instructions (e.g., computer program instructions) stored thereon that are executable by processor 214-1 and processor 214-2 to display a status on a manual call point in accordance with the present disclosure. That is, processor 214-1 and processor 214-2 can execute the executable instructions stored in memory 214-2 and a memory 212-2 to display a status on a manual call point in accordance with the present disclosure.

Memory 212-1 and memory 212-2 can be volatile or nonvolatile memory. Memory 212-1 and memory 212-2 can also be removable (e.g., portable) memory, or non-removable (e.g., internal) memory. For example, Memory 212-1 and memory 212-2 can be random access memory (RAM) (e.g., dynamic random access memory (DRAM), resistive random access memory (RRAM), and/or phase change random access memory (PCRAM)), read-only memory (ROM) (e.g., electrically erasable programmable read-only memory (EEPROM) and/or compact-disk read-only memory (CD-ROM)), flash memory, a laser disk, a digital versatile disk (DVD) or other optical disk storage, and/or a magnetic medium such as magnetic cassettes, tapes, or disks, among other types of memory.

Further, although memory 212-1 and memory 212-2 are illustrated as being located in manual call point 200 and emergency control panel 218, respectively, embodiments of the present disclosure are not so limited. For example, memory 212-1 and memory 212-2 can also be located internal to another computing resource (e.g., enabling computer readable instructions to be downloaded over the Internet or another wired or wireless connection).

The manual call point 200 can secure, monitor, and/or control the components of the fire alarm system via a wired or wireless network. The network 216 can be a network relationship through which manual call point 200 can communicate with the components of the fire alarm system (e.g., the emergency control panel 218), via a network 216. Examples of such a network relationship can include a distributed computing environment (e.g., a cloud computing environment), a wide area network (WAN) such as the Internet, a local area network (LAN), a personal area network (PAN), a campus area network (CAN), or metropolitan area network (MAN), among other types of network relationships. For instance, the network 216 can include a number of servers that receive information from, and transmit information to, manual call point 200 and the components of the fire alarm system via a wired or wireless network.

As used herein, a "network" can provide a communication system that directly or indirectly links two or more computers and/or peripheral devices and allows users to access resources on other computing devices and exchange messages with other users. A network can allow users to share resources on their own systems with other network users and to access information on centrally located systems or on systems that are located at remote locations. For example, a network can tie a number of computing devices together to form a distributed control network (e.g., cloud).

A network may provide connections to the Internet and/or to the networks of other entities (e.g., organizations, institutions, etc.). Users may interact with network-enabled software applications to make a network request, such as to get a file or print on a network printer. Applications may also communicate with network management software, which can interact with network hardware to transmit information between devices on the network.

The manual call point 200 can display an image that represents a status of the manual call point 200 for a fire alarm system using an e-paper display 202, as previously described herein. As previously described, there can be a number of images stored within the memory 212-1 of the manual call point, where each of the stored images can correspond to a determined status. For example, a first image indicating that the manual call point is operating normally (e.g., functioning), a second image indicating that the manual call point has been deactivated (e.g., non-functional), and a third image indicating that maintenance is being performed on the manual call point, among other images and statuses.

Additionally, the memory 212-1 of the manual call point 200 can store additional images that correspond to a zone of the facility the manual call point 200 corresponds to, represent a call number corresponding to the manual call point 200, and/or represent a logo used by the fire alarm system company the manual call point 200 is associated with. However, embodiments of the present disclosure are not limited to a such images.

As previously described, the manual call point 200 can determine that there has been a change in the status of the manual call point 200. In such an example, the manual call point 200 may self-diagnose a fault of the manual call point 200. For example, the manual call point 200 can determine that the manual call point 200 has been deactivated (e.g., non-functioning). In response to determining that the manual call point 200 has changed, the manual call point 200 can change the image, which is displayed on the e-paper display 202, that represents the status of the manual call point 200. In one example, the e-paper display 202 can automatically change from a first image indicating that the manual call point is functioning 200 to a second image indicating that the manual call point 200 is non-functioning. This can allow for occupants and/or technicians to be accurately informed of the current status of the manual call point 200.

Additionally, the manual call point 200 can notify the emergency control panel 218, via network 216, that there is a change in the status of the manual call point 200. In response to receiving the notification from the manual call point 200, the necessary maintenance can be performed on the manual call point 200. In such an example, the manual call point 200 can detect that maintenance is being performed and the e-paper display 202 can display an image indicating that maintenance is being performed, and thus, the manual call point 200 is non-functional.

Additionally, the emergency control panel 218 can transmit a notification to the manual call point 200 indicating that there is a change in the status of the manual call point 200. For example, in a case where a technician is performing maintenance on the manual call point 200, the emergency control panel 218 can send instructions to the manual call point 200 to change the image displayed on the e-paper display 202 representing the status of the manual call point. Thus, the technician does not need to manually change the status of the manual call point prior to performing the necessary maintenance.

In another example, the emergency control panel 218 can transmit a notification to the manual call point 200 indicating that there is a change in the status of the fire alarm system. For instance, the emergency control panel 218 can send instructions to the manual call point to change the image displayed on the e-paper display 202 to indicate that at least one component (e.g., a fire detector or alarm) of the fire alarm system that is associated with the manual call point 200 is deactivated. This can allow for occupants and/or technicians to be accurately informed of the current status of the fire alarm system.

The manual call point 200 can also be receive input from an occupant that an emergency situation has occurred. For example, in response to detecting an emergency situation, such as a fire, a occupant can apply pressure to the manual call point (e.g., presses a button situated on the manual call point). Upon receiving input from the user, the manual call point 200 can notify (e.g., send a message), via network 216, the emergency control panel 218 of the emergency situation. The emergency control panel 218 can then verify that there is an emergency situation and activate an alarm and/or alert emergency service. In another example, the emergency control panel 218 can notify the manual call point 200 of an emergency situation in response to detecting the emergency situation.

Figure 3:
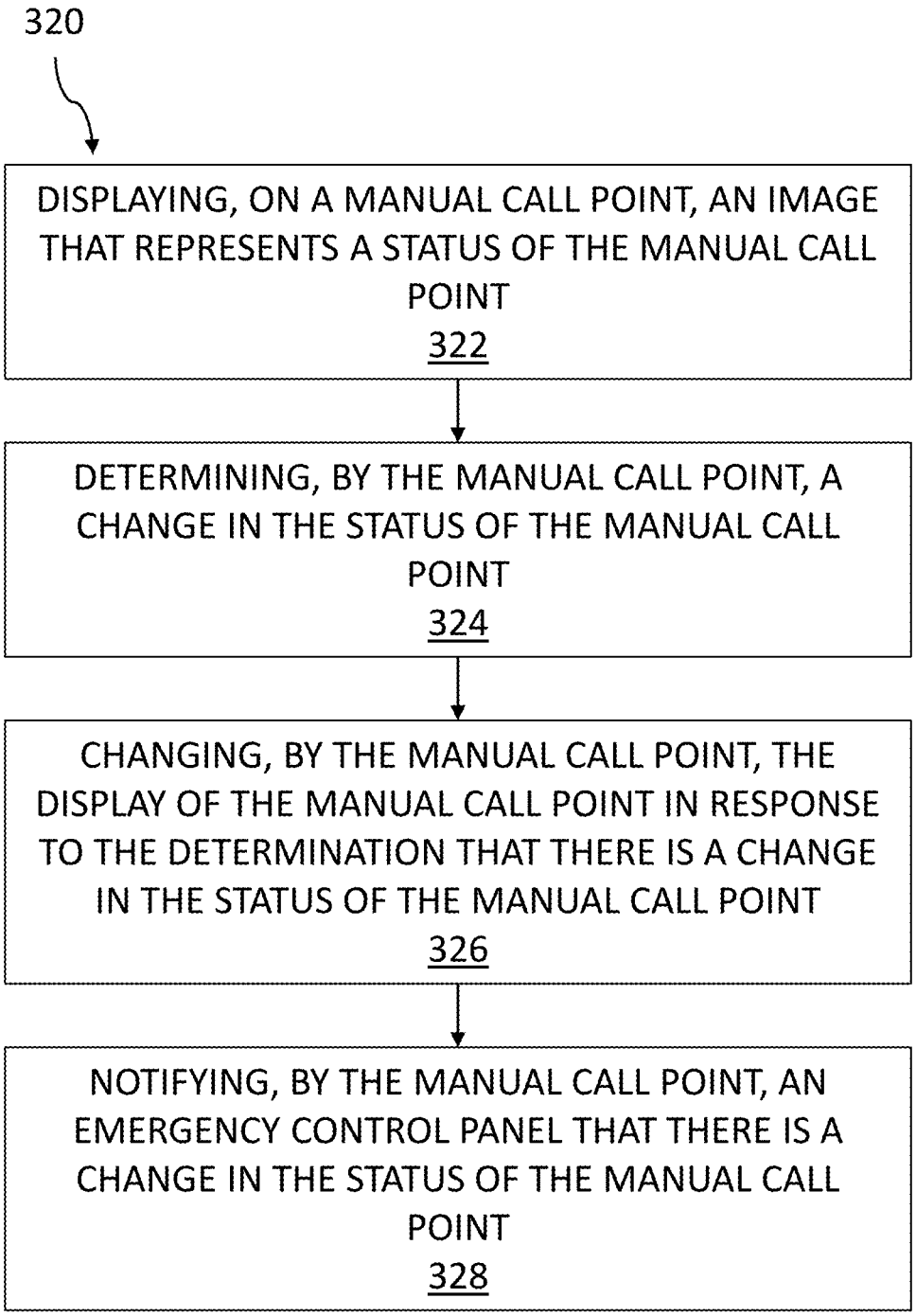
FIG. 3 illustrates an example of a method for displaying a status on a manual call point in accordance with an embodiment of the present disclosure.

FIG. 3 illustrates an example of a method 320 for displaying a status on a manual call point in accordance with an embodiment of the present disclosure. The manual call point can be, for example, manual call point 100 previously described in connection with FIG. 1. For instance, the manual call point can be a manual call point utilized within a fire alarm system to display the status of the manual call.

At block 322, method 320 includes displaying, on an e-paper display of a manual call point, an image that represents a status of the manual call point. The image that represents the status of the manual call point can be displayed on the manual call point, for example, in a manner analogous to that previously described in connection with FIG. 1. As described herein, the image can be displayed on a e-paper display, which can be configured to display the image in the absence of power being supplied to the e-paper display.

At block 324, method 320 includes determining, by the manual call point, a change in the status of the manual call point. The change in the status of the manual call point can be determined by the manual call point, for example, in a manner analogous to that previously described in connection with FIG. 1.

At block 326, method 320 includes changing, by the manual call point, the image displayed on the e-paper display of the manual call point in response to the determination that there is a change in the status of the manual call point. The display of the manual call point can be changed by the manual call point in response to the determination that there is a change in the status of the manual call point, for example, in a manner analogous to that previously described in connection with FIG. 1.

At block 328, method 320 includes notifying, by the manual call point, an emergency control panel that there is a change in the status of the manual call point. The emergency control panel can be notified by the manual call point that there is a change in the status of the manual call point, for example, in a manner analogous to that previously described in connection with FIG. 1.

Additionally, as described herein, the manual call point can display an image that represents the status of a particular zone of the fire alarm system. For instance, if any one of the components associated with the same zone that the manual call point is associated with has been deactivated, the manual call point can display an image that indicates that there is a fault in the fire alarm system of the particular zone.

Figure 4A:
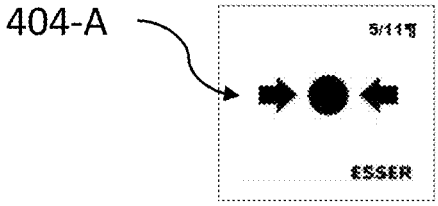
FIGS. 4A-4C illustrate examples of images displayed on a manual call point in accordance with an embodiment of the present disclosure.
Figure 4B:
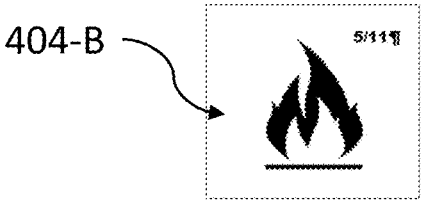
Figure 4C:
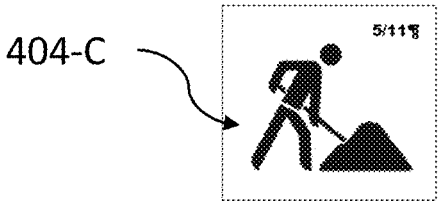

FIGS. 4A-4C illustrate examples of images displayed on a manual call point in accordance with an embodiment of the present disclosure. As previously described, a manual call point, such as manual call point 100 shown in FIG. 1, can display an image 404-A, 404-B, 404-C that represents a status of the manual call point.

For example, possible images can include a first image 404-A indicating that the manual call point is operating normally (e.g., functioning), a second image 404-B indicating that the manual call point has been deactivated (e.g., non-functional), and a third image 404-C indicating that maintenance is being performed on the manual call point. Embodiments of the present disclosure are not limited to such images.

Although specific embodiments have been illustrated and described herein, those of ordinary skill in the art will appreciate that any arrangement calculated to achieve the same techniques can be substituted for the specific embodiments shown. This disclosure is intended to cover any and all adaptations or variations of various embodiments of the disclosure.

It is to be understood that the above description has been made in an illustrative fashion, and not a restrictive one. Combination of the above embodiments, and other embodiments not specifically described herein will be apparent to those of skill in the art upon reviewing the above description.

The scope of the various embodiments of the disclosure includes any other applications in which the above structures and methods are used. Therefore, the scope of various embodiments of the disclosure should be determined with reference to the appended claims, along with the full range of equivalents to which such claims are entitled.

In the foregoing Detailed Description, various features are grouped together in example embodiments illustrated in the figures for the purpose of streamlining the disclosure. This method of disclosure is not to be interpreted as reflecting an intention that the embodiments of the disclosure require more features than are expressly recited in each claim.

Rather, as the following claims reflect, inventive subject matter lies in less than all features of a single disclosed embodiment. Thus, the following claims are hereby incorporated into the Detailed Description, with each claim standing on its own as a separate embodiment.

What is claimed is:

1. A manual call point, comprising:

an e-paper display configured to display an image that represents a status of the manual call point;

a memory; and a processor configured to execute executable instructions stored in the memory to:

determine a change in the status of the manual call point; and change the image displayed by the e-paper display in response to the determination that there is a change in the status of the manual call point.

2. The manual call point of claim 1, wherein the e-paper display is configured to display an image that represents information indicating a zone the manual call point corresponds to.

3. The manual call point of claim 1, wherein the e-paper display is configured to display an image that represents a logo.

4. The manual call point of claim 1, wherein the e-paper display is configured to display an image that represents a call point number corresponding to the manual call point.

5. The manual call point of claim 1, wherein the e-paper display displays an image indicating that the manual call point is operating normally, has been deactivated, or that maintenance is being performed on the manual call point.

6. The manual call point of claim 1, wherein the e-paper display is configured to display the image in response to power not being supplied to the e-paper display.

7. The manual call point of claim 1, wherein the processor is configured to execute the executable instructions stored in the memory to receive a notification to change the image displayed by the e-paper.

8. The manual call point of claim 1, wherein the processor is configured to execute the executable instructions stored in the memory to notify an emergency control panel that there is a change in the status of the manual call point in response to the determination that there is a change in the status of the manual call point.

9. A system, comprising:

a manual call point, configured to:

display, on an e-paper display of the manual call point, an image that represents a status of the manual call point;

determine a change in the status of the manual call point;

change the image displayed on the e-paper display of the manual call point in response to the determination that there is a change in the status of the manual call point; and notify an emergency control panel that there is a change in the status of the manual call point in response to the determination that there is a change in the status of the manual call point; and the emergency control panel, configured to:

receive a notification from the manual call point indicating that there is a change in the status of the manual call point.

10. The system of claim 9, wherein the emergency control panel is coupled to a number of devices associated with a fire alarm system.

11. The system of claim 10, wherein the emergency control panel is configured to receive a notification from at least one of the plurality of devices that there is a change in the operational status of the at least one device.

12. The system of claim 9, wherein the manual call point notifies the emergency control panel of an emergency situation in response to receiving input from a user.

13. The system of claim 9, wherein the manual call point and the emergency control panel are coupled via a wired network.

14. The system of claim 9, wherein the manual call point and the emergency control panel are coupled via a wireless network.

15. The system of claim 9, wherein the emergency control panel is further configured to notify the manual call point of an emergency situation.

16. A method for displaying a status on a manual call point, comprising:

displaying, on an e-paper display of a manual call point, an image that represents a status of the manual call point;

determining, by the manual call point, a change in the status of the manual call point;

changing, by the manual call point, the image displayed on the e-paper display of the manual call point in response to the determination that there is a change in the status of the manual call point; and notifying, by the manual call point, an emergency control panel that there is a change in the status of the manual call point.

17. The method of claim 16, further comprising initiating an alarm, by the manual call point, in response to a verification of an emergency situation.

18. The method of claim 16, further comprising receiving a notification from the emergency control panel that at least one of a plurality of devices corresponding to a fire alarm system has been deactivated.

19. The method of claim 18, wherein the at least of the plurality of devices is a fire detector.

20. The method of claim 16, further comprising:

receiving input from a user that an emergency situation has occurred; and notifying the emergency control panel of the emergency situation in response to the received input.

* * * * *